US005845349A

United States Patent [19]

Tharalson et al.

[11] Patent Number: 5,845,349

[45] Date of Patent: Dec. 8, 1998

[54] MULTIPLE PURPOSE CONVERTIBLE PLAYPEN

[75] Inventors: Douglas E. Tharalson; Diana M. Tharalson, both of Agoura, Calif.

[73] Assignee: Arms Reach Concepts, Inc., Malibu, Calif.

[21] Appl. No.: 903,640

[22] Filed: Jul. 31, 1997

Related U.S. Application Data

[60] Provisional application No. 60/039,728 Feb. 19, 1997.

[51] Int. Cl.[6] ..... A47D 7/02

[52] U.S. Cl. ..... 5/99.1; 5/93.1; 5/95

[58] Field of Search ..... 5/99.1, 93.1, 93.2, 5/97, 98.1, 655, 95

[56] References Cited

U.S. PATENT DOCUMENTS

| | | | |
|---|---|---|---|
| 2,553,087 | 5/1951 | Hanson | 5/93.1 |
| 3,735,430 | 5/1973 | Platz | 5/93.1 |
| 5,163,191 | 11/1992 | Chan | 5/99.1 |
| 5,172,435 | 12/1992 | Griffin et al. | 5/99.1 |
| 5,339,470 | 8/1994 | Shamie | 5/93.2 |
| 5,349,709 | 9/1994 | Cheng | 5/93.1 |
| 5,553,336 | 9/1996 | Mariol | 5/93.1 |

*Primary Examiner*—Michael F. Trettel
*Assistant Examiner*—Fredrick Conley
*Attorney, Agent, or Firm*—Beehler & Pavitt

[57] ABSTRACT

A first playpen enclosure that converts easily to a bassinet, a changing table or a bed-side crib (hereinafter referred to as a "co-sleeper") that attaches securely to the parents' bed. A described second enclosure support system maintains a padded enclosure and rigid floor panel at a predetermined level below the top of the playpen to form the bassinet. The second enclosure has a back, two sides, a bottom and a front flap that overhangs the front horizontal rail. The upper front corners are segmented into a removable section and a fixed section to facilitate the removal and unseating of the front horizontal rail to a second position at a first predetermined distance from the top position. Cooperating junctures affixed to the front vertical rails accept the removable sections and securely seat the rail in this second position. The supports, padded enclosure and rigid floor panel complete the changing table with the front flap hanging down in front. The playpen can be placed adjacent the parents' bed with the front flap extended over the bed for use as a co-sleeper. For such use, uniquely designed reinforcing straps secure the unit to the parents' bed and prevent the co-sleeper from sliding, buckling or lifting. The unit is easily folded with the components into a compact package carrying case for transport or storage.

14 Claims, 6 Drawing Sheets

30
31
32
33
34
35
36
39
40
41
42
43
44
45
46
47
48
49
50
53
54
69
72
2A
3
4

42
39
37
83
38
42
39

55
56
54
57
43

36
42
37
38
42

37
38
39

54

42
37
6
42
38
51
39
6

67
66
68
73
71
74
53
18
16
52
82
34
69
70
72

MULTIPLE PURPOSE CONVERTIBLE PLAYPEN

This application claims the benefit of U.S. Provisional Application Number 60/039,728 filed on Feb. 19, 1997.

FIELD OF THE INVENTION

The instant invention relates to the field of convertible units for use with babies and very young children; in particular to units which may be easily converted to a playpen, a bassinet, changing table, or child's bed-side sleeping enclosure, hereinafter referred to for convenience as a "co-sleeper", that attaches securely to the parents' bed.

BACKGROUND OF THE INVENTION

Play yards and playpens for babies and young children are well known and many variations have been marketed over the years. Low portable cribs have also been used as playpens. For economy of space and finances it has been practical to find additional uses for playpens, such as bassinets and changing tables, by means of easy alterations or adjustments that are reversible.

In U.S. Pat. No. 2,548,769, Burgin teaches a crib that can be lowered for use as a playpen. Shamie, in U.S. Pat. No. 5,339,479 teaches a portable playpen that can be converted to a changing table by adding an upper level using zippers to hold the upper floor in place. Several levels of zipper teeth provide different height for the upper floor. Mariol adds an upper level to a playpen to provide a bassinet. The short legs of the upper level are inserted into openings in the top of the vertical supports of the playpen. (U.S. Pat. No. 5,553,336). Saldana teaches a unit designed for home and travel that may be used as a support for a playpen, bassinet or baby chair (U.S. Pat. No. 2,691,176). U.S. Pat. No. 5,581,827 to Fong et al. discloses a foldable playpen unit.

Beside cribs that attached to the parents' bed were known at the turn of the century (U.S. Pat. Nos. 5,548,005; 620,069; 1,138,451; 1,283,169; 1,267,244) but fell out of favor for many years. Recently there has been a resurgence in the practice of having babies sleep adjacent the parents' bed. Such bed-side cribs are taught in U.S. Pat. No. 5,172,435 to Griffin et al.; U.S. Pat. No. 5,148,561 to Tharalson et al; and U.S. Pat. No. 5,293,655 to Van Winkle et al.

It is an object of the present invention to provide a single unit that with quick and easy adjustments can be adapted for several different purposes, including a playpen, a bassinet, a changing table and a co-sleeper.

It is another object of the present invention to provide a unit that can be converted to a co-sleeper that is an improvement over the prior art, that rests on four legs, will not lift, tip or buck and that is secured to the parents' bed with a safety strap so it cannot slide away from the bed.

Another object of the present invention is to allow conversion to a co-sleeper crib while still maintaining the stability of the unit by the repositioning of the front horizontal rail.

It is a further object of the present invention that the co-sleeper be adjacent the parents' bed but at a level below the level of the parents' bed and with a fabric extension covering the separation so there is no chance of the baby being injured.

Another object of the present invention is to provide means to adjust the height of the co-sleeper to conform to the different bed heights.

A still further object of the present invention is to provide a secure washable enclosure for the baby.

Another object of the present invention is to provide a playpen in which a baby can be tended by a care giver that is physically handicapped.

A further object of the present invention is to provide a unit which folds easily for storage and transport.

Other features and advantages of the invention will be seen from the following description and drawings.

SUMMARY OF THE INVENTION

The present invention is a playpen which may be easily converted for use as a bassinet, changing table and co-sleeper. The playpen is comprised of a first rigid enclosure having an open top, a floor, a front wall, and at least one surrounding wall connected to the front wall. The enclosure is of sufficient height to confine a small child inside. A means is provided for reversibly lowering the height of at least a portion of the front wall, from a first position at the top to a second position, a first predetermined distance from the top, to while maintaining structural rigidity of the playpen.

A second enclosure is provided, sized to fit substantially within the first enclosure. The second enclosure has an open top, a bottom and at least one surrounding wall. A means is provided for removably supporting the second enclosure means within the first enclosure a second predetermined distance from the top of the first enclosure. Finally, a securing strap assembly is provided for securing the playpen to a parental bed.

When the front wall is in the raised first position and the second enclosure is supported by the supporting means, the playpen is usable as a bassinet. When the front wall is lowered to the second position the playpen is usable as a changing table. Further, when the securing strap assembly means is properly positioned and the playpen is secured to the parental bed the playpen may serve as a co-sleeper.

The preferred embodiment of the invention is a playpen convertibly adapted for use as a bassinet, changing table and co-sleeper. The playpen comprises a rigid first enclosure having an open top, a floor, a front wall, a back wall, a first side wall and a second side wall. The first enclosure is of sufficient height to confine a small child inside.

The enclosure has a rigid frame, the frame being formed at the top by front and rear upper parallel horizontal rails and first and second upper side parallel rails and two upper front corner members and two upper rear corner members connected together. The frame is formed adjacent the floor by front and rear lower parallel horizontal rails and first side and second side lower parallel horizontal rails and four lower corner leg members connected together. A pair of front vertical rails and a pair of rear vertical rails are connected to the two upper front corner members and the two upper rear corner members and the four lower corner leg members. The rigid frame supports the floor, the front wall, the back wall, the first side wall and the second side wall.

Each upper front corner member is constructed of two reversibly separable complementary sections. The first of these sections is fixedly attached to an end of the upper front horizontal rails. The second of these sections is fixedly attached to the upper end of one of the front vertical rails. The upper front corner members support the upper front horizontal rail in its first position. A receiving means is fixedly attached to each front vertical rail at a first predetermined distance from the top for receiving the first sections of the upper front corner members and reversibly maintaining the upper front horizontal rail in a second position, thereby maintaining structural rigidity of the playpen when the upper front horizontal rail is in the second position.

A second enclosure is sized to fit substantially within the first enclosure and includes an open top, a back wall, first and second side walls and a bottom. A means is provided for removably supporting the second enclosure means within the first enclosure a second predetermined distance from the top of the first enclosure. A securing strap assembly is provided for securing to a parental bed with alignment means through which the securing strap assembly is directed for maintaining the securing strap assembly in horizontal orientation and preventing lifting or bucking of the playpen when used as a co-sleeper. Finally, an attachment means is provided for fastening the securing strap assembly to the playpen.

The playpen is ready for use as a co-sleeper when the upper front horizontal rail is in its second position, the second enclosure is supported by the second enclosure support means, the securing strap assembly is directed through the alignment means, fastened to the attachment means and is properly positioned and secured to the parental bed.

In a variant of the preferred embodiment the floor of the playpen includes a lower floor panel attached to the lower horizontal rails of the rigid frame and an upper floor panel suspended above the lower floor panel and attached to the front, rear, first side and second side walls. This arrangement provides a shock absorbing space between the upper floor panel and the lower floor panel. A hollow leg member is attached to the underside of the lower floor panel to provide support for the lower floor panel and a loop is attached to the undersurface of the lower floor panel and passing through the lower floor panel and the upper floor panel to form a handle for use in collapsing the playpen.

In another variant of the invention, the rigid frame of the playpen is collapsible. In this variant the rigid frame further includes a means for pivotally mounting the front and rear upper horizontal rails to the upper front corner members and upper rear corner members, respectively. Frame locking devices are positioned at center points of the front and rear upper horizontal rail with pivotal mounting, thereby permitting the upper rails to pivot downwardly from the open top of the first enclosure. In addition a means is provided for pivotally mounting the upper first side and upper second side horizontal rails to the upper front and rear corner members. Frame pivoting devices are positioned at center points of the upper first and upper second side horizontal rails with pivotal mounting thereby permitting each of the rails to pivot upwardly from the open top of the first enclosure.

Means are also provided for pivotally mounting the lower first side and lower second side horizontal rails to the lower front and rear corner members. Frame pivoting devices are positioned at center points of the lower first and lower second side horizontal rails with pivotal mounting thereby permitting each of said rails to pivot upwardly from the floor of the first enclosure. Also means are provided for pivotally mounting the lower front and rear horizontal rails to the lower front and rear corner members, respectively. Frame pivoting devices are positioned at center points of the lower front and rear horizontal rails with pivotal mounting thereby permitting each of the rails to pivot upwardly from the floor of the first enclosure.

The frame may be quickly folded into a compact package for transport and storage by releasing the locking devices positioned on the front and rear horizontal rails and depressing the upper horizontal rails downwardly while pulling upwardly on the handle attached to the floor. This causes the upper and lower side horizontal rails and lower front and rear horizontal rails to bend upwardly and the vertical rails to move inwardly.

In a further variant of the invention the second enclosure includes a removable rigid floor member sized to fit within the second enclosure and capable of supporting a child upon it and an elongated front flap for receiving the rigid floor member and being sized to extend over a portion of the parental bed. The removable rigid floor member has a top surface and a bottom surface and is covered with a washable fabric and padded on its top surface. It is desirable that the removable rigid floor member is segmented into two or more segments closely aligned, is capable of being folded, and is covered with a washable fabric and padded on its top surface. It is desirable that the second enclosure is padded and washable.

In another variant of the invention, the second enclosure support means is sized to maintain the bottom of the second enclosure at level substantially four inches below the front horizontal rail when disposed in the second position.

In yet another variant of the invention, the securing strap assembly further includes a strap member of a length greater than twice the width of the parental bed with a first end and a second end, a resistance plate member, attachment cooperation means and adjusting means. The resistance plate member has at least two slots vertically aligned and centrally disposed through which the strap members is threaded such that the first end and the second end are equidistant from the plate. The attachment cooperation means are slidably engaged near the first end and the second end of the strap member for reversible connection to the securing strap receiving means. The adjusting means are provided for adjusting the length of the strap member and fixedly tightening the strap member after connecting the attachment cooperation means to the security strap receiving means.

The strap member is properly positioned when disposed between the mattress and box spring or platform of the parental bed and held in place by the resistance pate disposed vertically at the side of the parental bed opposite placement of the co-sleeper and the strap member is tightened so the co-sleeper is held fast to the parental bed.

In another variant of the preferred embodiment, height adjusting means are provided for changing the height of the co-sleeper such that the level of the front horizontal rail when located in the second position is substantially even with a top of a mattress of the parental bed. The height adjusting means includes extensions cooperating with each of the four lower corner leg members.

In yet another variant of the invention, a reversible separation means is located on each side of the front wall for substantially the first predetermined distance from the top for facilitating the repositioning of the front horizontal rail and attaching same to the receiving means on the front vertical rails.

In another variant, the first section of the front upper corner member is a male section and the second section is a female section and the receiving means is a female connecting means for connection with the male section. The opening in the female section and the receiving means is sufficiently small so as to prevent small children or infants from inserting their fingers into the openings.

DETAILED DESCRIPTION OF THE INVENTION

Figures 1, 2A, 2B:
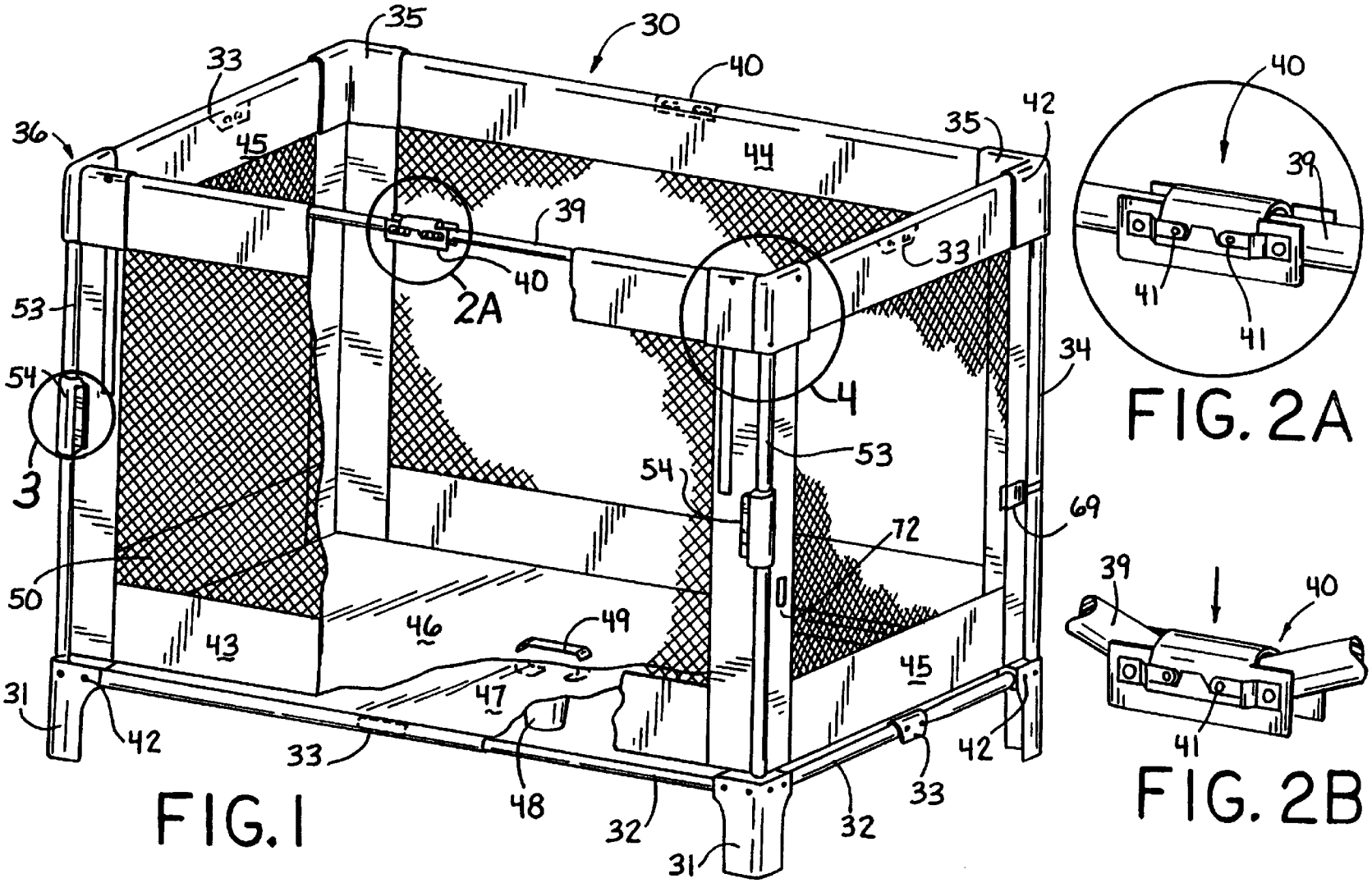
FIG. 1 is a perspective view of the playpen of the instant invention partially cut away to reveal certain features.
FIG. 2A is a close-up perspective view of the front horizontal rail fold section in extended orientation.
FIG. 2B is a close-up perspective view of the front horizontal rail fold section in collapsed orientation.
Figures 3, 4, 5, 6, 7, 8:
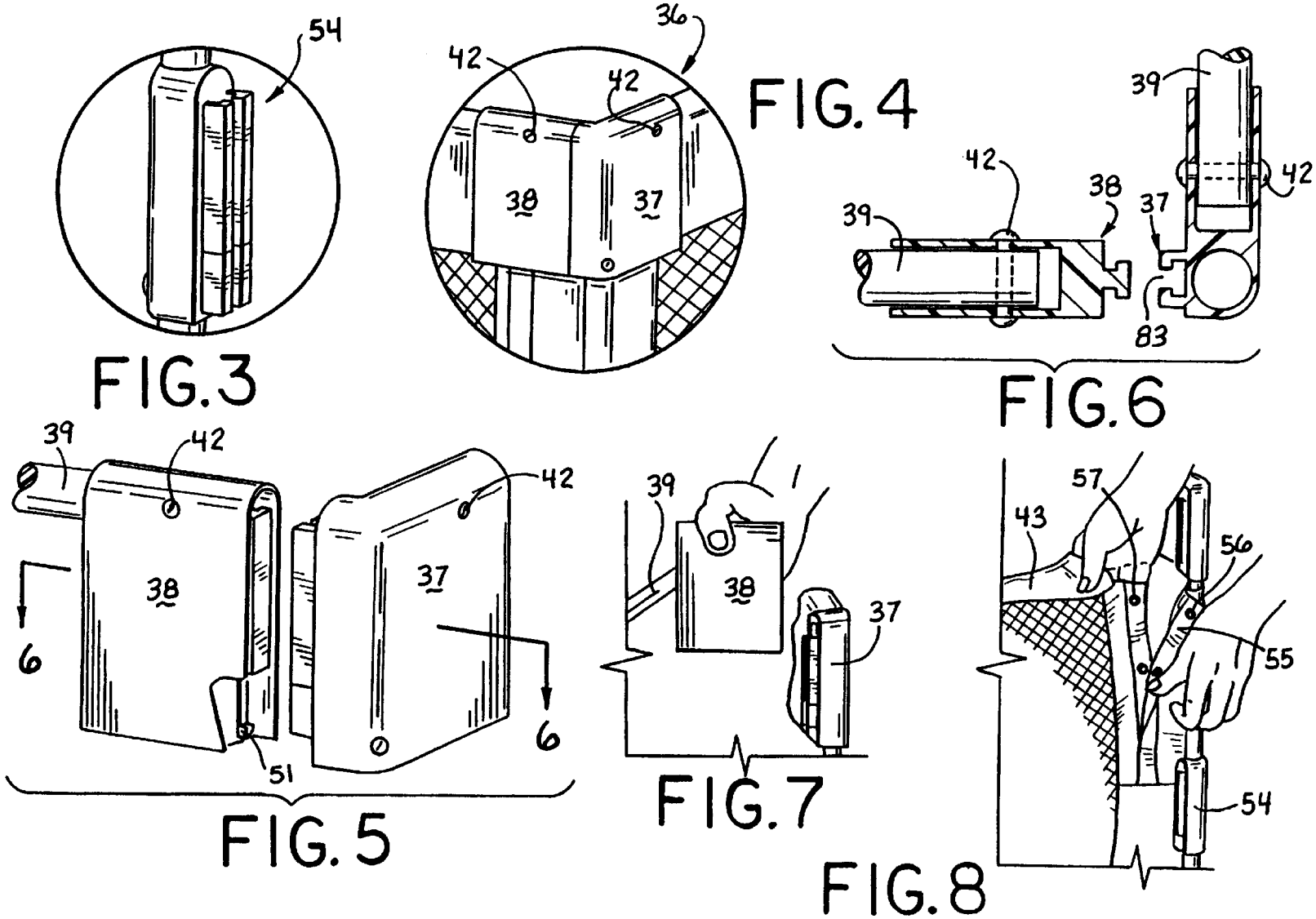
FIG. 3 is a close-up perspective view of the female receiver.
FIG. 4 is a close-up perspective view of the male and female components of the right front upper corner in attached configuration.
FIG. 5 is a perspective view of the male and female components of the right front upper corner of FIG. 4 in separated configuration.
FIG. 6 is a sectional view through line 6—6 of FIG. 5.
FIG. 7 shows the method of connecting the male and female components of the right front upper corner.
FIG. 8 is a perspective view showing the snap attachments at the right side of the playpen.

The basic unit 30 is a playpen as shown in FIG. 1 with a frame assembly having lower corners or legs 31 which are pivotally connected to lower horizontal rails 32 by pivot pins 42. In the center of each of the lower horizontal rails is a pivot connecting member 33 which permits the rails to pivot upward only. Two front vertical rails 53 and two back vertical rails 34 are joined to the lower corners 31. The upper corners are also coupled to each vertical rail. The rear upper corners 35 are of a single construction, while the front upper corners 36 are fabricated in two sections, a female section 37 and a male section 38, that slidably and reversibly interact to complement each other. See FIGS. 4, 5, 6 and 7. There are two hooking projections 51 at the bottom inside of the male sections 38 as seen in FIG. 5, that lock into receiving ledges (not illustrated) in the female sections 37 for added security. The hooking projections 51 must be released by hand before the two sections can be separated. They prevent a child from being able to pull up on the male section 38 and effect a separation of the two components. Upper horizontal rails 39 are pivotally connected to the upper corners by means of pivot pins 42. There is a frame lock 40 at the midpoint of each upper horizontal rail 39 that locks the rail in a straight line configuration. When the frame lock contact points 41 are manually depressed, the upper horizontal rails pivot downwardly, as seen in FIGS. 2A and 2B.

The upper horizontal rails 39 and the lower horizontal rails 32 are pivotally connected to the upper corner 35 and 36 and lower corners 31 to facilitate the folding and assembling of the play pen 30. The upper rails 39 pivot downwardly only when the frame lock contact points 41 are depressed and they lock the upper rail 39 securely when the upper rail 39 is in straight line configuration. Since the lower horizontal rails 32 can only pivot upwardly, this happens when the unit 30 is being folded and cannot occur when a child is in the play pen 30. It is impossible for the unit to collapse or fold in any way during use.

There is a first enclosure composed of four vertical panels, the front panel 43, back panel 44, two side panels 45, and two horizontal floor panels, the upper floor panel 46 and lower floor panel 47. The vertical panels are stitched to form channels along the top edges to receive the upper horizontal rails 39 and along the sides to receive the vertical corner rails 34 and 53. The top edge channels are also lined on the inside with a foam padding to provide cushioning that prevents injury to the child. The upper floor panel 46 is stitched to the bottom of each vertical panel (43, 44 and 45) and forms the floor of the unit, but it is not otherwise supported. Stitched channels in the lower floor panel 47 receive the lower horizontal rails 32 which support the lower floor panel 47. There is a natural air gap between the two floor panels which acts as a shock absorber. Each of the vertical panels (43, 44 and 45) has a mesh window 50 for visual contact with the child and for air circulation. These structures are all illustrated in FIG. 1.

A hollow leg member 48 is affixed to the underside of the lower floor panel 47 to provide support thereto and a loop 49 is stitched to the undersurface of the lower floor panel 47 and passes through the lower floor panel 47 and the upper floor panel 46 forming a handle 49. When the unit 30 is to be folded, the frame locks 40 on the upper horizontal rails 39 are released, the rails 39 are bent downwardly and the handle 49 is pulled upward causing the lower horizontal rails 32 to bend upwardly and the whole play pen 30 to collapse inwardly into a compact unit. A zippered carrying case is provided for ease of transport and storage (not shown).

Figure 9:
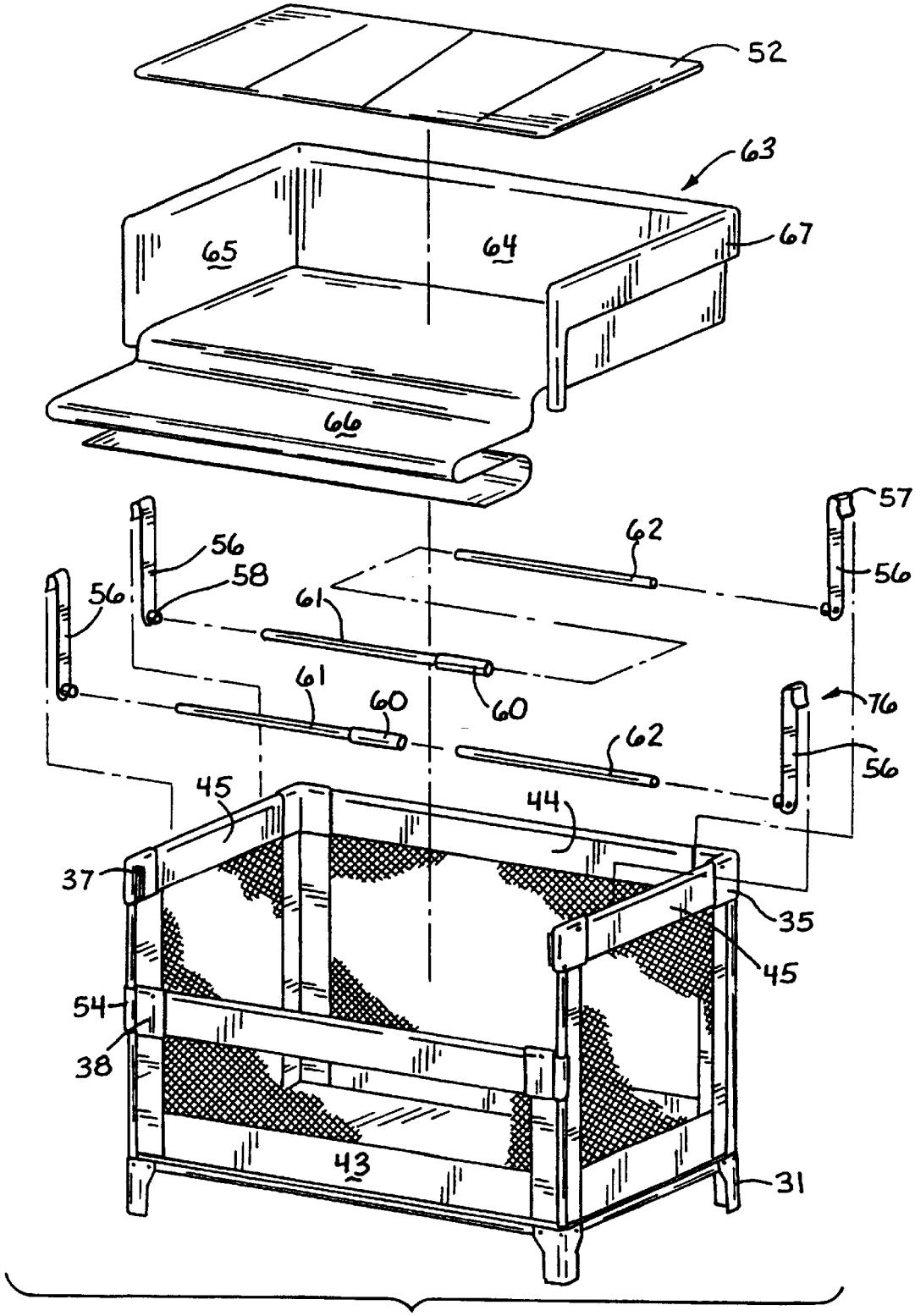
FIG. 9 is a perspective exploded view of the main components of the playpen and showing the front horizontal rail in the second position.

A rigid removable floor 52 is also provided and is illustrated in FIG. 9. The removable floor 52 is covered with the same fabric as are the panels (43, 44 and 45) and additionally is padded on the top surface. It is divided into at least two sections so that it can be folded around the collapsed unit for storage. The sections are held together by the fabric cover that has stitched compartments to hold the sections in close alinement while still allowing the floor 52 to fold. This rigid floor 52 rests atop the upper floor panel 46 when the unit is used as a playpen 30. It is removed and repositioned as described below when the unit is converted to its other forms.

Figure 10:
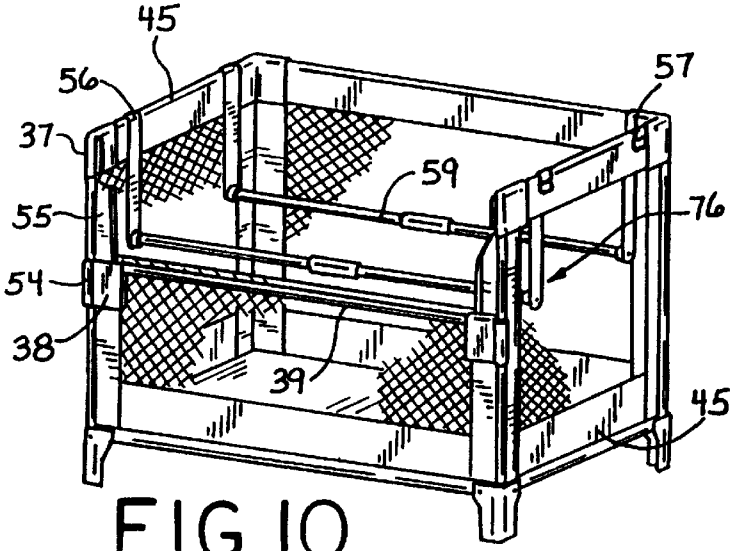
FIG. 10 is a perspective view of the unit with the front horizontal rail in the second position and second enclosure supports in position.

There is an second enclosure level support system 76 seen in FIG. 10 which is necessary to convert the unit 30 to a bassinet, changing table or co-sleeper. Two support struts 56 are hooked over the upper horizontal rails 39 on each side of the unit, forming two sets of opposing struts. The top of each strut is bent over backwards forming a curved hook 57 that snaps securely over the rail 39. The struts hang down along the inside surface of the side panels 45. The length of each strut is slightly such that the second enclosure is supported a first predetermined distance below top of the playpen 30. As illustrated in FIG. 9, collar 58 is fixedly mounted at the bottom of each strut 56 on the surface facing inside the playpen. A dowel 59 is inserted into the collars 58 of of each set of opposing struts 56 (FIG. 10). The dowel can be a single piece, or as illustrated in FIG. 9, each dowel is in three parts, two rods 61 and 62 and a connecting sleeve 60. The sleeve is permanently joined to a first rod 61 and a second rod 62 is releasably fitted into the sleeve. Spring activated buttons and strategically positioned opening (not shown) secure the second rod 62 into the sleeve of the first rod 61 and also secure the rods in the collars 58, each of which has an opening to receive the button.

Figure 11:
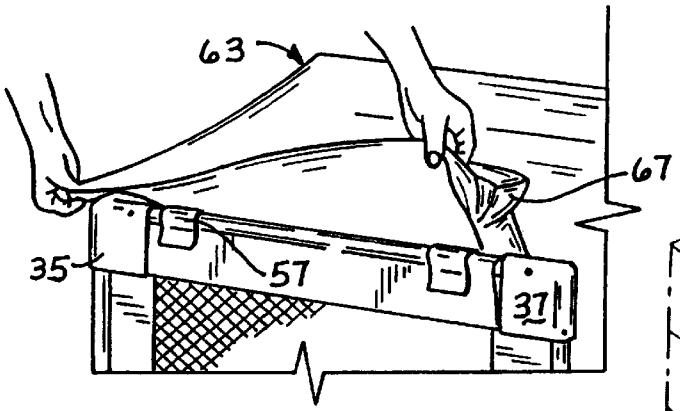
FIG. 11 shows the placement of the second enclosure on the unit as illustrated in FIG. 10.

A second enclosure 63 is now placed over the upper horizontal rails 39 and extends down to the second enclosure support system 76. The second enclosure 63 has a back wall 64 and two side walls 65. There is no front wall, but there is a long front flap 66 that extends upward over the front horizontal rail 39 and hangs down the front of the playpen. The fabric of the walls is folded over the front vertical rails 53, front corners 36 and back and side horizontal rails 39 forming a continuous apron 67 that covers those structures. The apron helps to seat the enclosure 63 and to maintain a tight fit against the rails 39. See FIGS. 11 and 12. The rigid removable floor 52 is placed padded side up into the second enclosure 63 and is supported on the dowels 59. The unit is now ready for use as a bassinet.

Converting the unit to a changing table or co-sleeper involves one additional step before the second enclosure support system is put into place. The front horizontal rail 39 is moved from its first position to its second position which is substantially a predetermined distance from the top of the unit.

At a point on each of the front vertical rails 53, at approximately a first predetermined distance from the top, is securely affixed a female receiver 54 designed to accept the male section 38 of the front upper corner 36. See FIGS. 1 and 3. As shown in FIG. 8, the fabric of the front panel 43 is separated along its two side edge for the same distance. When the unit is used as a play pen, the two parts are joined by a series of snaps covered by a fabric flap 55. The male snap portions 56 are affixed to the front panel and the female snap portions 57 are affixed to the underside of the fabric flap 55.

To convert the unit to a changing table or co-sleeper, the upper third of the front panel 43 is separated from the stitched channel by opening the snaps on each side and the upper front horizontal rail 39 is moved to the second position as shown in FIG. 10. To accomplish this, the frame lock contact points 41 (FIG. 2A) are depressed, the horizontal rails 39 bent slightly downward, and the two male sections 38 (FIG. 4) of the front upper corners 36 (FIG. 1) are grasped and lifted upward while releasing the hooking projections 51 (FIG. 5), next the male sections 38 are separated from the female sections 37 and the front horizontal rail 39 can be lifted upward and forward. The male sections 38 are thereafter relocated to the female receivers 54 (FIGS. 1 and 3) to seat the front horizontal rail 39 in the second position. This is partially illustrated in FIGS. 7 and 8. The portion of fabric that is now in excess, is merely folded to the inside of the unit.

It is essential that the front horizontal rail 39 be repositioned and not removed completely from the unit 30. In the second position, as in the first position, the rail acts as a brace to maintain the front vertical rails 53 in proper alignment. The front horizontal rail 39, in either position, is necessary to the integrity and stability of the unit 30.

Figure 12:
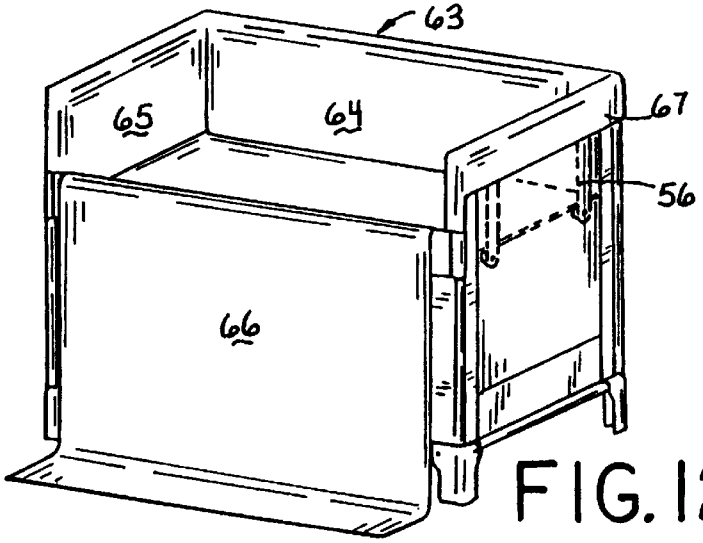
FIG. 12 is a perspective view of the unit as illustrated in FIG. 10 with the second enclosure in place and the flap hanging down in front for use as a changing table.
Figure 13:
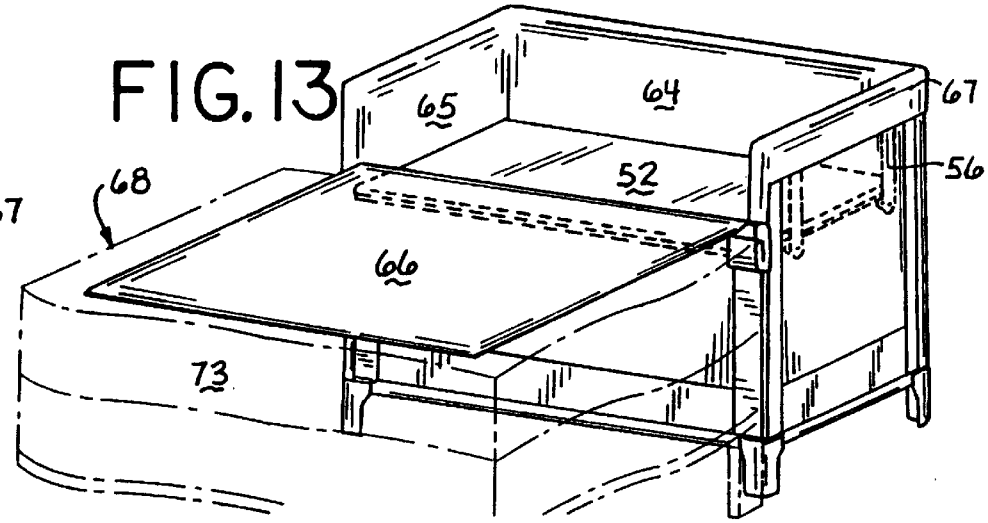
FIG. 13 is a perspective view of the unit as illustrated in FIG. 12 adjacent a bed with the flap extended over the bed and the rigid floor placed on the second enclosure for use as a co-sleeper.

Once the front horizontal rail 39 is securely seated in the second position, the upper level support system 76 is put into place as previously described. The unit 30 with the front horizontal rail 39 in the second position and the upper level support system 76 in place is illustrated in FIG. 10. The second enclosure 63 (FIGS. 11 and 12) is fitted into place and the rigid floor 52 is positioned into the second enclosure (FIG. 13). For use as a changing table, the front flap 66 hangs down in front of the unit, as seen in FIG. 12. When placed against a bed 68 with the front flap 66 extended over the bed, the unit 30 is a co-sleeper, as seen in FIG. 13. The front flap 66 extends a good distance over the parents' mattress 73 and completely covers the space between the co-sleeper and the parents' bed 68. The extension is long enough and is padded so it will lie flat and will not bunch up or crease.

As shown in FIG. 13, the level of the repositioned front horizontal rail 39 should be at the height of the top of the mattress 73 of the parental bed 68. The level of the rigid floor 52 in the upper position is from three to seven inches, but preferably four inches (10.2 cm) below the reseated front horizontal rail 39 and therefore it will be substantially the same distance below the top of the mattress 73 of the parental bed 68. This difference in level prevents the baby from being able to roll over onto the parents' bed while still maintaining the baby within easy reach of the parent.

For use as a co-sleeper, the unit 30 must be securely anchored so that it cannot tip, lift, bunch or slide away from the parental bed 68. Merely attaching the front of the frame of the co-sleeper to the parental bed by a hook or short strap is not sufficient and can put the baby in jeopardy. To provide sufficient attachment, a securing strap assembly 82 is used. The strap 71 itself is a strip of strong, tightly woven material of a length more than twice the width of the parental bed 68. The strap can be made long enough to be used with a king sized bed and supplied with shortening means for use on all smaller beds.

Figures 14, 15, 16, 17, 18:
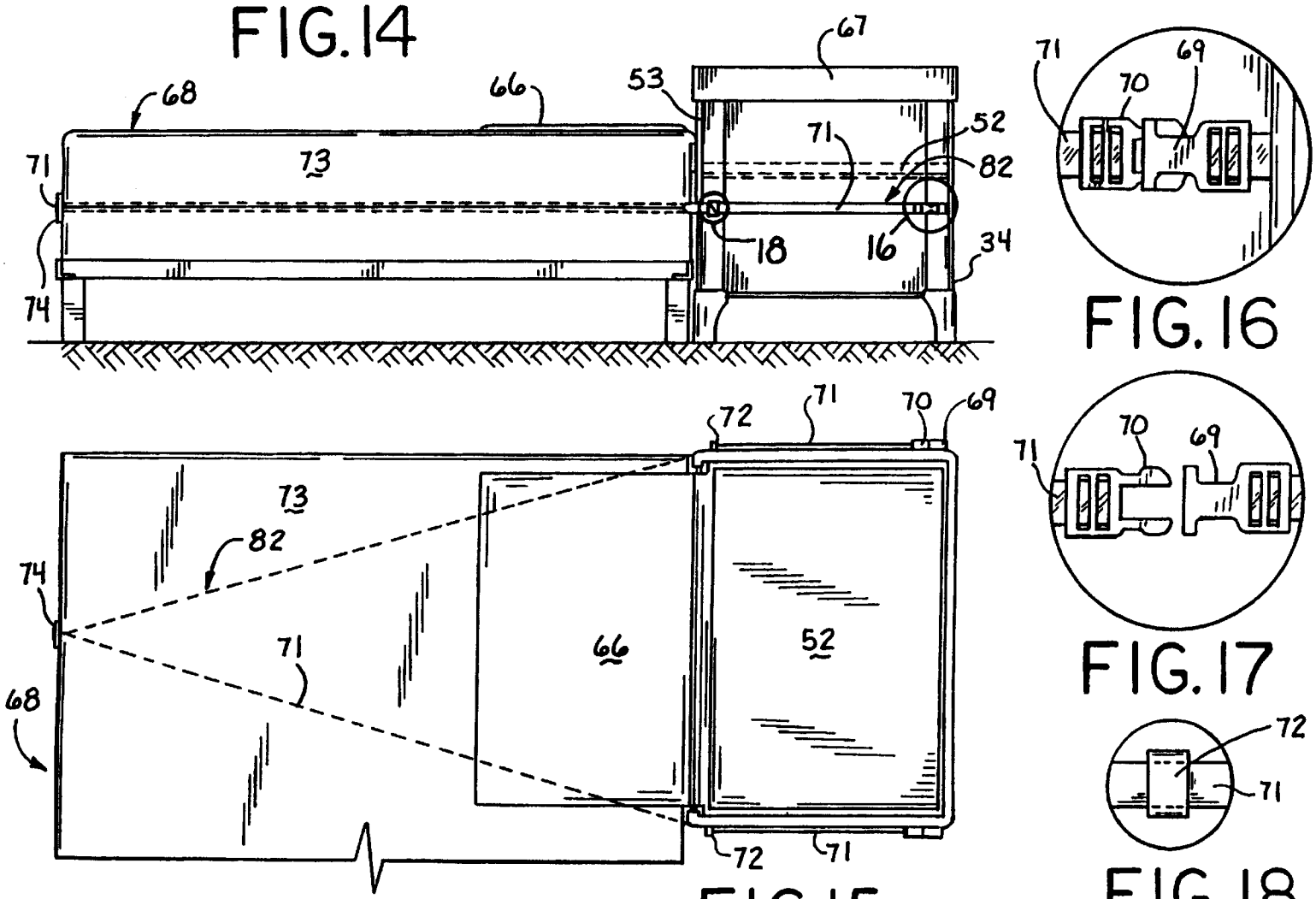
FIG. 14 is side elevational view of the co-sleeper attached to the parents' bed by means of the safety strap assembly.
FIG. 15. is a top plan view of the co-sleeper and attachment of FIG. 14 and also showing the configuration of the safety strap assembly.
FIG. 16 is a close-up view of the securing strap attachment means and securing strap receiving means in engaged configuration.
FIG. 17 is close-up view of the securing strap attachment means and securing strap receiving means about to be engaged.
FIG. 18 is a close-up view of the alignment means for the safety strap.
Figure 19:
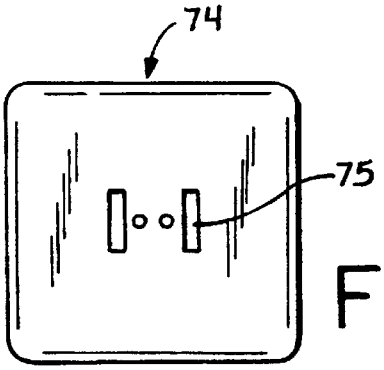
FIG. 19 is front elevational view of the resistance plate for securing the securing strap assembly.
Figure 20:
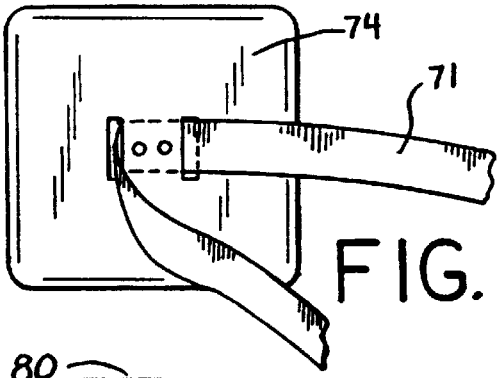
FIG. 20 shows the resistance plate of FIG. 19 with the securing strap assembly affixed thereto.

As FIGS. 14–20 illustrate, the securing strap assembly 82 consists of the strap 71, a resistance plate 74, shortening rings (not shown), and clasps 70. The flat resistance plate 74 is at least six inches by six inches (15.2 cm×15.2 cm) in size and made of a strong rigid material. There are two slots 75 located near the center of the resistance plate and illustrated in FIG. 19. The ends of the securing strap 71 are threaded through the slots 75 and pulled through until the plate is at the midpoint of the strap. The strap is secured to the plate at its midpoint by stitches, rivets or any other means known in the art. See FIG. 20. As illustrated in FIGS. 16 and 17, the ends of the securing strap 71 are thereafter threaded through the clasps 70 and doubled back through shortening rings. Any shortening rings, clamps or loops known in the art can be used as long as there is no slippage when the strap is tightened. These are not illustrated.

As illustrated in FIGS. 14 and 15, the resistance plate 74 is placed in vertical orientation at the distal side of the parental bed 68 and the ends of the strap 71 are brought under the mattress 73 of the parental bed 68 and out the proximal side where the co-sleeper is located. The ends of the strap 71 are moved apart until each end is at one side of the co-sleeper. The two sections of the strap 71 form a V-shape as seen in FIG. 15. Each end of the strap 71 then passes through an alignment means 72 attached at the side of each front vertical rail 53 and the securing attachment means 70 are connected to the securing strap receiving means 69 which are attached at the sides of the rear vertical rails 34. The alignment means 72 and securing strap receiving means 69 are attached at the height of the bottom of the mattress 73 of the parental bed 68 so the straps 71 remain horizontal for best security. Once the clasps 70 are engaged, the ends of the strap 71 are pulled until the strap 71 is taut and maintained that way by the shortening rings and the co-sleeper is held securely against the parental bed 68.

Co-sleepers of the prior art often did not rest on four legs and were not securely joined to the parental bed. They could slip away or lift up easily. The securing strap assembly 82 of the instant invention provides both resistance to slippage and prevents lifting, tipping and bucking movements. The secured strap 71 and securing attachment means 70 hold the co-sleeper in place and the alignment means 72 illustrated in FIGS. 14, 15 and 18 prevent it from lifting, tipping or bucking. If the co-sleeper were to be attached only at the front, the back end could easily lift, so both the securing attachment means 70 at the back of the playpen 30 and the attachment means 72 at the front are essential for the proper use, security and stability of the playpen 30 as a co-sleeper.

Figure 21:
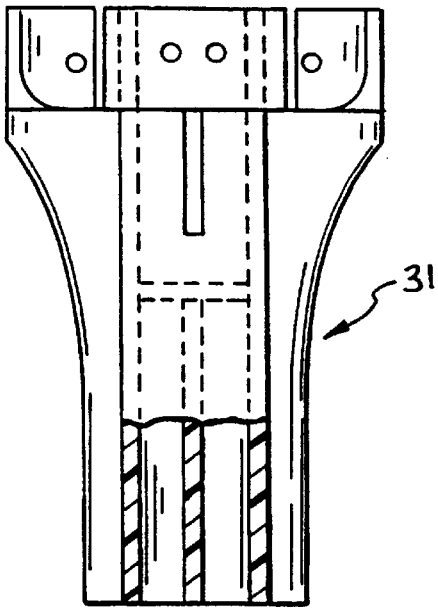
FIG. 21 is partial cut-away side elevational view of the lower corner of the playpen.
Figure 22:
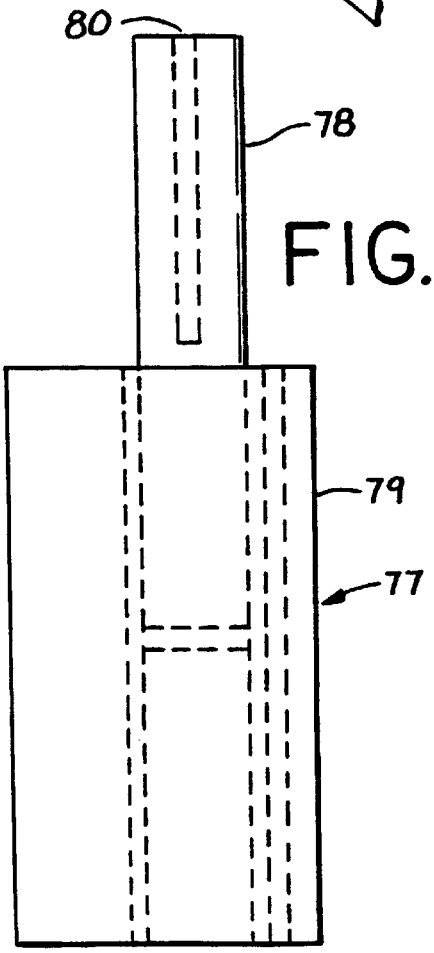
FIG. 22 is side elevational view of the leg extension insert.
Figure 23:
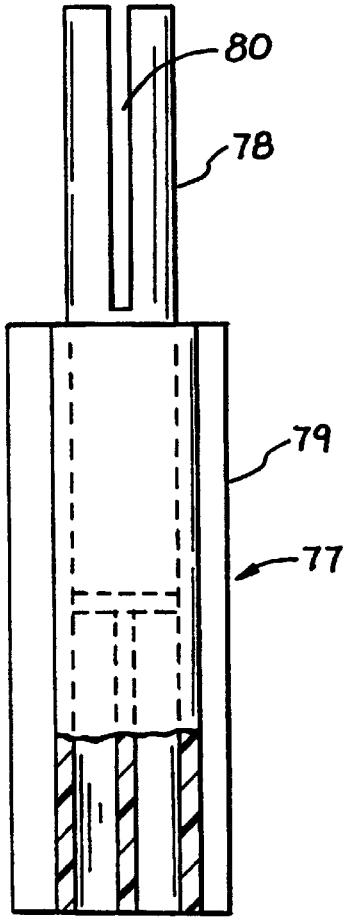
FIG. 23 is a partial cross-sectional view of the leg extension insert viewed from the vantage point of FIG. 21.

There are many types of beds with mattresses at varying heights from the floor. Some of the newer mattresses are considerably thicker then the older ones and could present a problem when the co-sleeper is to be utilized. FIGS. 22 and 23 illustrate a leg extension 77 which is used to raise the level of the playpen 30 so the securing strap assembly 82 is horizontal for a secure attachment, and the sleeping level of the bay is three to seven inches below the top of the parents' mattress 73. FIG. 21 shows the lower corner 31 of the playpen partially cut away to expose the interior configuration. The leg extension 77 is sized and configures to closely fit inside the lower corner 31. The extension 77 has an upper section 78 and a lower section 79. The upper section 78 fits completely within the lower corner 31 and has a vertical slot 80 that divides the upper section 78 in two parts and which forms a tight connection with the interior of the lower corner 31. The lower section 79 extends below the lower corner 31 and a right angle corner that exactly copies the shape of the existing lower corner 31 and is co-extensive therewith. This lower section 79 is two inches (5 cm) in height. Additional two inch (5 cm) extensions 77 can be added. The upper portion 78 of each of these nest inside the one above it so the outward appearance is of a longer leg.

The basic playpen 30 and each modification and addition are designed for the optimum safety of the child or infant using it. The configuration of the female section 37 of the front upper corner 36 and the female receiver 54 (FIGS. 1 and 3) contain an open channel 83 seen in FIG. 6 that could pose a problem for small fingers. To eliminate this problem, the channel is sufficiently small that fingers of small children or infants will not fit into the channel.

Each of the steps in converting the unit from one form to another, assembling the unit or folding it for storage is completely reversible, easy to accomplish and requires no special strength, dexterity or tools.

The rails, corners, and legs of the unit can be made of any rigid an strong material Metals and polymeric material scan most easily be formed as needed. Polymeric materials can be injection molded to produce the interconnecting corner sections. The fabric of the sides, floors and enclosure must be strong, durable and washable. Nylon mesh inserts for the panels can be sewn or otherwise secured in the front, back and side panels. The struts and dowels can also be constructed of metal or a polymeric material.

As previously noted, the entire unit can be quickly folded into a compact package for storage or transport. The second enclosure 63, support struts 56, dowels 59, rigid floor 52 and the securing strap assembly 82 are set aside (FIGS. 9 and 15). The frame lock contact points 41 (FIG. 2A) on each upper horizontal rail 39 are depressed until the rails each bend downwardly and the handle 49 is pulled upward. This causes the lower horizontal rails 32 to bend upwardly and the vertical rails 34 and 53 to move inwardly (FIG. 1). All of the other components except the rigid floor 52 are then placed in the center and unit 30 collapsed compactly. The rigid floor 52 can now be folded around the unit 30 to act as a container and the whole thing is placed into a zippered carrying case (not shown) with the loop 49 extending outside for use as the carrying handle.

There are occasions when the child's caregiver is unable to bend over or is in a wheelchair. This situation makes putting a child into and taking the child out of the playpen quite difficult. Removing the front horizontal rail 39 from the first position and reseating it in the second position just prior to doing either task and immediately replacing it in the first position makes these tasks considerably easier. The front horizontal rail 39 should never be left in the second position when the unit 30 is used as a playpen. A person in a wheelchair can most easily utilize this unit as a changing table or bassinet.

While one embodiment of the present invention has been illustrated and described in detail, it is to be understood that this invention is not limited thereto and may be otherwise practiced within the scope of the following claims.

We claim:

1. A playpen convertibly adapted for use as a bassinet, changing table and co-sleeper comprising:

a rigid first enclosure having an open top, a floor, a front wall, a back wall, a first side wall and a second side wall;

said enclosure being of sufficient height to confine a small child therewithin;

said enclosure having a rigid frame, said frame being formed at the top by front and rear upper parallel horizontal rails and first and second upper side parallel rails and two upper front corner members and two upper rear corner members in cooperation therewith, and being formed adjacent the floor by front and rear lower parallel horizontal rails and first side and second side lower parallel horizontal rails and four lower corner leg members in cooperation therewith, and a pair of front vertical rails and a pair of rear vertical rails in further cooperation with the two upper front corner members and the two upper rear corner members and the four lower corner leg members;

said rigid frame supporting the floor, the front wall, the back wall, the first side wall and the second side wall;

each upper front corner member being constructed of two reversibly separable complementary sections, the first of said sections being fixedly attached to an end of the upper front horizontal rail and the second of said sections being fixedly attached to the upper end of one of the front vertical rails, said upper front corner members supporting the upper front horizontal rail in its first position;

receiving means fixedly attached to each front vertical rail at a first predetermined distance from the top for receiving the first section of an upper front corner member and reversibly maintaining the upper front horizontal rail in a second position, thereby maintaining structural rigidity of the playpen when the upper front horizontal rail is in the second position;

a second enclosure, said second enclosure being sized to fit substantially within the first enclosure and having an open top, a back wall, first and second side walls and a bottom;

means for removably supporting said second enclosure means within the first enclosure a second predetermined distance from the top of the first enclosure;

a securing strap assembly for securing to a parental bed;

alignment means through which the securing strap assembly is directed for maintaining the securing strap assembly in horizontal orientation and preventing lifting or bucking of the playpen when used as a co-sleeper; and attachment means for fastening the securing strap assembly to the playpen;

wherein the playpen is ready for use as a co-sleeper when the upper front horizontal rail is in the second position, the second enclosure is supported by the second enclosure support means, the securing strap assembly is directed through the alignment means, fastened to the attachment means and is properly positioned and secured to the parental bed.

2. A convertible playpen as in claim 1, wherein the floor further comprises:

a lower floor panel attached to the lower horizontal rails of the rigid frame;

an upper floor panel suspended above the lower floor panel and attached to the front, rear, first side and second side walls, thereby providing a shock absorbing space between the upper floor panel and the lower floor panel;

a hollow leg member affixed to an underside of the lower floor panel to provide support thereto; and a loop attached to an undersurface of the lower floor panel and passing through the lower floor panel and the upper floor panel forming a handle for use in collapsing the playpen.

3. A convertible playpen as in claim 1, wherein the rigid frame further comprises:

means for pivotally mounting the front and rear upper horizontal rails to the upper front corner members and upper rear corner members, respectively;

frame locking devices positioned at center points of the front and rear upper horizontal rail pivotally mounted thereto and permitting said upper rails to pivot downwardly from the open top of the first enclosure;

means for pivotally mounting the upper first side and upper second side horizontal rails to the upper front and rear corner members;

frame pivoting devices positioned at center points of the upper first and upper second side horizontal rails pivotally mounted thereto and permitting each of said rails to pivot upwardly from the open top of the first enclosure;

means for pivotally mounting the lower first side and lower second side horizontal rails to the lower front and rear corner members;

frame pivoting devices positioned at center points of the lower first and lower second side horizontal rails pivotally mounted thereto and permitting each of said rails to pivot upwardly from the floor of the first enclosure;

means for pivotally mounting the lower front and rear horizontal rails to the lower front and rear corner members, respectively; and frame pivoting devices positioned at center points of the lower front and rear horizontal rails pivotally mounted thereto and permitting each of said rails to pivot upwardly from the floor of the first enclosure;

wherein said frame may be quickly folded into a compact package for transport and storage by releasing the locking devices positioned on the front and rear horizontal rails and depressing the upper horizontal rails downwardly while pulling upwardly on the handle attached to the floor, thereby causing the upper and lower side horizontal rails and lower front and rear horizontal rails to bend upwardly and the vertical rails to move inwardly.

4. A convertible playpen configured as a co-sleeper as described in claim 1, wherein the second enclosure is padded and washable.

5. A convertible playpen configured as a co-sleeper as described in claim 1, wherein the second enclosure further comprises:

a removable rigid floor member being sized to fit within said second enclosure and capable of supporting a child thereon; and an elongated front flat for receiving the rigid floor member and being adapted to extend over a portion of the parental bed.

6. A convertible playpen configured as a co-sleeper as described in claim 5, wherein the removable rigid floor member has a top surface and a bottom surface and is covered with a washable fabric and padded on its top surface.

7. A convertible playpen configured as a co-sleeper as described in claim 5, wherein the removable rigid floor member is segmented into two or more segments closely aligned, is capable of being folded, and is covered with a washable fabric and padded on its top surface.

8. A convertible playpen configured as a co-sleeper as described in claim 1, wherein the second enclosure support means is sized to maintain the bottom of the second enclosure at level substantially four inches below the front horizontal rail when disposed in the second position.

9. A convertible playpen configured as a co-sleeper as described in claim 1, wherein the securing strap assembly further comprises:

a strap member having a first end and a second end;

a resistance plate member having at least two slots vertically aligned and centrally disposed through which the strap members is threaded such that the first end and the second end are equidistant from the plate;

attachment cooperation means slidably engaged near the first end and the second end of the strap member for reversible connection to the securing strap receiving means; and adjusting means for adjusting the length of the strap member and fixedly tightening same after connecting the attachment cooperation means to the security strap receiving means;

wherein the strap member is properly positioned when disposed under the mattress of the parental bed and held in place by the resistance pate disposed vertically at the side of the parental bed opposite placement of the co-sleeper and the strap member is tightened so the co-sleeper is held fast to the parental bed.

10. A convertible playpen configured as a co-sleeper as described in claim 1, further comprising height adjusting means for changing the height of the co-sleeper such that the level of the front horizontal rail when disposed in the second position is substantially even with a top of a mattress of the parental bed.

11. A convertible playpen configured as a co-sleeper as described in claim 9, wherein the height adjusting means comprises extensions cooperating with each of the four lower corner leg members.

12. A convertible playpen configured as a co-sleeper as described in claim 1, further comprising reversible separation means disposed on each side of the front wall for substantially the first predetermined distance from the top for facilitating the repositioning of the front horizontal rail and attaching same to the receiving means on the front vertical rails.

13. A convertible playpen as described in claim 1 wherein the first section of the front upper corner member is a male section and the second section is a female section, said second section having an opening sufficiently small so as to prevent entry of small fingers of children or infants.

14. A convertible playpen as described in claim 1, wherein the receiving means is a female connecting means for connection with the male section, said receiving means having an opening sufficiently small so as to prevent the entry of small fingers of children or infants.

* * * * *